US009472164B2

(12) United States Patent
Matsumoto

(10) Patent No.: US 9,472,164 B2
(45) Date of Patent: Oct. 18, 2016

(54) DISPLAY APPARATUS LIGHT EMISSION CONTROL METHOD AND DISPLAY APPARATUS

(71) Applicant: NICHIA CORPORATION, Anan-shi, Tokushima (JP)

(72) Inventor: Makoto Matsumoto, Tokushima (JP)

(73) Assignee: NICHIA CORPORATION, Anan-shi (JP)

( * ) Notice: Subject to any disclaimer, the term of this patent is extended or adjusted under 35 U.S.C. 154(b) by 146 days.

(21) Appl. No.: 13/717,700

(22) Filed: Dec. 18, 2012

(65) Prior Publication Data

US 2013/0162696 A1 Jun. 27, 2013

(30) Foreign Application Priority Data

Dec. 26, 2011 (JP) ..... 2011-284554

(51) Int. Cl.
*G09G 3/32* (2016.01)
*G09G 5/10* (2006.01)

(52) U.S. Cl.
CPC *G09G 5/10* (2013.01); *G09G 3/32* (2013.01); *G09G 3/3216* (2013.01); *G09G 2300/06* (2013.01); *G09G 2320/0233* (2013.01)

(58) Field of Classification Search
CPC ..... G09G 5/10; G09G 3/3216; G09G 3/32; G09G 2300/06; G09G 2320/0233
USPC ..... 345/76–84
See application file for complete search history.

(56) References Cited

U.S. PATENT DOCUMENTS 6,351,076 B1 2/2002 Yoshida et al.
2002/0021263 A1 2/2002 Honda et al.
2003/0197472 A1* 10/2003 Kanauchi ..... G09G 3/3266 315/169.1
2005/0007321 A1* 1/2005 Schuler ..... 345/82
2006/0187157 A1* 8/2006 Chang ..... 345/82

(Continued)

FOREIGN PATENT DOCUMENTS

JP 62-220986 9/1987
JP 2-205890 8/1990

(Continued)

OTHER PUBLICATIONS

Japanese Office Action for corresponding JP Application No. 2001-284554, Sep. 29, 2015 (w/ machine translation).

(Continued)

*Primary Examiner* — Rodney Amadiz
(74) *Attorney, Agent, or Firm* — Mori & Ward, LLP

(57) ABSTRACT

A method controls a display that includes a display portion, a scanner, and a driver. The display portion includes light emitting elements arranged in a matrix form. The scanner is connected to common lines each of which is connected to corresponding elements that are arranged in a corresponding row. The scanner applies a voltage to a selected common line. The driver is connected to driving lines each of which is connected to corresponding elements that are arranged in a corresponding column. The driver activates selected elements. The method controls the display whereby displaying an image in each cycle including frames. The voltage is applied to the selected one of the common lines in a lighting frame in which the light emitting elements are driven in one cycle. The scanner is prevented from applying the voltage in a non-lighting frame in which the elements are not driven in the one cycle.

19 Claims, 8 Drawing Sheets

(56) References Cited

U.S. PATENT DOCUMENTS

| | | | | |
|---|---|---|---|---|
| 2007/0171180 | A1* | 7/2007 | Akiyama | 345/102 |
| 2008/0186258 | A1 | 8/2008 | Ishimoto et al. | |
| 2008/0266277 | A1* | 10/2008 | Ichikura | G09G 3/3216 345/205 |
| 2010/0109996 | A1* | 5/2010 | Park et al. | 345/100 |

FOREIGN PATENT DOCUMENTS

| | | |
|---|---|---|
| JP | 09-325729 | 12/1997 |
| JP | 10-214058 | 8/1998 |
| JP | 2001-109427 | 4/2001 |
| JP | 2002-023689 | 1/2002 |
| JP | 2003-122289 | 4/2003 |
| JP | 2005-003768 | 1/2005 |
| JP | 2005-156960 | 6/2005 |
| JP | 2006-147933 | 6/2006 |
| JP | 2007-094009 | 4/2007 |
| JP | 2007-248902 | 9/2007 |
| JP | 2008-191353 | 8/2008 |

OTHER PUBLICATIONS

Japanese Office Action for corresponding JP Application No. 2011-284554, May 10, 2016.

* cited by examiner

DISPLAY APPARATUS LIGHT EMISSION CONTROL METHOD AND DISPLAY APPARATUS

BACKGROUND OF THE INVENTION

1. Field of the Invention

The present invention relates to a display apparatus that employs light emitting elements arranged in a matrix, and a light emission control method for controlling the display apparatus.

2. Description of the Related Art

Display apparatuses that employ light emitting diodes (LEDs) as light emitting elements have been manufactured. For example, a large display system can be constructed of a plurality of display apparatuses that cooperate with each other. In the case where a display apparatus is constructed in a matrix with m rows and n columns for example, the anode terminals of LEDs that are arranged in each row are connected to corresponding one common line, while the cathode terminals of LEDs that are arranged in each column are connected to corresponding one driving line. The common lines of m rows are cyclically turned ON one by one at a predetermined sub-frame. When one of the common lines is turned ON, each of the driving lines can drive corresponding one of LEDs that are arranged on the one of the common lines, which is turned ON.

In this display apparatus control method, there is a problem that the brightness of light emitting elements that are first driven in each cycle may be smaller as compared with other light emitting elements. The reason is described with reference to FIGS. 7 to 9. FIG. 7A is a plan view schematically showing a display apparatus. FIG. 7B is a plan view schematically showing the display apparatus with the brightness of a row being smaller. FIG. 8 is a timing chart showing the light emission timing of light emitting elements 1 in a conventional display apparatus. The following description describes the case where one cycle is divided into a plurality of frames for displaying one image. The frames are controlled so that one image can be displayed as a whole. FIGS. 9A to 9H are circuit diagrams showing the current flows in the display apparatus in sub-frames 11 to 23 in FIG. 8. FIGS. 9A, 9B, 9C, 9D, 9E, and 9F show the sub-frames 11, 12, 13, 21, 22, and 23, respectively, in the cycle CL1. FIG. 9G shows the state where residual electric charge is stored. FIG. 9H shows the sub-frame 11 in the cycle CL2 or later. In FIGS. 9 A to 9H, light emitting elements 1 shown in black are light emitting elements 1 that emit light at a desired amount of intensity. Current flows are shown by the arrows. Virtual equivalent capacitors $C_{S0}$ to $C_{S2}$ that are included as parasitic capacitances in the lines are shown on the driving lines S0 to S2 (hereinafter, S0 to S2 are occasionally referred to as simply lines "S").

The display apparatus shown in FIGS. 7A and 7B includes a display portion in a matrix with three rows and three columns. Each dot includes an LED as light emitting element. This display apparatus will have the circuit construction states shown in FIGS. 9A to 9H. The display apparatus includes the light emitting elements 1 that are arranged in the matrix with three rows and three columns (totally nine light emitting elements), three common lines C0 to C2 (hereinafter, C0 to C2 are occasionally referred to as simply lines "C"), the three driving lines S0 to S2, a scanning portion 20, and a driving portion 30. Each of the common lines C0 to C2 is connected to the anode terminals of three light emitting elements 1, which are arranged in corresponding one of the three rows. Each of the three driving lines S0 to S2 is connected to the cathode terminals of three light emitting elements 1 that are arranged in corresponding one of the three columns. The common lines C0 to C2 are scanned by the scanning portion 20. The driving portion 30 can draw currents from the driving lines S0 to S2 so that the currents can flow through light emitting elements 1.

FIG. 8 shows the light emission timing chart of the display apparatus. As shown in this chart, the first cycle CL is indicated by CL1. The first cycle CL is first provided to the display apparatus after power is supplied. The second and third cycles are indicated by CL2 and CL3, respectively. Each of CL1 to CL3 is divided into a plurality of frames FM. In the frames, the scanning order of the common lines C is the same order of C0, C1, and C2. The assumed operation is that, in each cycle, all of the light emitting elements are driven at the minimum intensity (the minimum level) only in FM1, and all of the light emitting elements are turned OFF in other frames. That is, the assumed operation is that, in each of the cycles CL1 to CL3, all the light emitting elements emit light at the minimum intensity. In FIG. 8, although it is shown as if the light emitting elements 1 connected to S0, S1, and S2 are driven at the maximum intensity (maximum level) in the sub-frames 11, 12, and 13 in each cycle for ease of illustration, the assumed operation is that the light emitting elements are driven at the minimum intensity (the minimum level) in FM1.

The operation in the cycle CL1 is now described with reference to FIG. 9A. In the sub-frame 11 where the common line C0 to be first scanned is turned ON in the frame FM1, a voltage is applied to the common line C0 by the scanning portion 20, while predetermined currents are drawn by the driving portion 30 through the driving lines S0 to S2. Accordingly, three light emitting elements 1 that are connected to C0 are driven at a desired amount of intensity. Subsequently, in the sub-frame 12, as shown by FIG. 9B, the voltage is applied to the common line C1 by the scanning portion 20, while predetermined currents are drawn by the driving portion 30 through the driving lines S0 to S2. Accordingly, three light emitting elements 1 that are connected to C1 are driven at a desired amount of intensity. Similarly, in the sub-frame 13, as shown in FIG. 9C, three light emitting elements 1 that are connected to C2 are driven at a desired amount of intensity.

After that, in the sub-frame 21 in frame FM2, as shown in FIG. 9D, although the voltage is applied to the common line C0, the driving lines are in the OFF state so that the driving portion 30 does not draw currents. Accordingly, the parasitic capacitances of the lines (S0, S1, and S2) will be charged. Similarly, in the sub-frame 22, as shown in FIG. 9E, although the voltage is applied to the common line C1, the driving portion 30 does not draw currents. Accordingly, the parasitic capacitances of the lines (S0, S1, and S2) will be charged. Similarly, in the sub-frame 23, as shown in FIG. 9F, the parasitic capacitances of the lines (S0, S1, and S2) will be also charged. In this case, since the lines are similarly scanned in the frames, the parasitic capacitances of the lines will be fully charged and cannot be charged anymore as shown in FIG. 9G.

The operation in the cycle CL2 is now described. The light intensity of a light emitting element that is first driven will be smaller in the cycle CL2 as compared with the cycle CL1. That is, as shown by FIG. 9H, since, in the sub-frame 11 in the frame FM1, the voltage is applied to the common line C0 by the scanning portion 20, and predetermined currents are drawn by the driving portion 30 through the driving lines S0 to S2, three light emitting elements 1 that are connected to C0 are driven.

However, since the parasitic capacitances of the driving lines S0 to S2 are charged in the cycle CL1, the amounts of the currents that are drawn by the driving portion through the driving lines S0 to S2 include not only currents that flow in the light emitting elements 1 but also currents from the parasitic capacitances. That is, since the current that actually flows in the light emitting element 1 in the sub-frame 11 decreases by the amount of current that is discharged by the parasitic capacitance relative to the currents in other sub-frames 12 and 13, the light emission amount of the light emitting element 1 that is connected to C0 in the sub-frame of the cycle CL2 will be smaller as compared with other light emitting elements 1 that are connected to C1 and C2. As a result, a so-called "dark line" phenomenon may occur.

In FIG. 8, to show that light emitting elements 1 may be darker in the sub-frames 11 of the cycles CL2 and CL3, the sub-frame blocks indicating that C0 is in the ON state are hatched in the cycles CL2 and CL3. Also, in FIG. 9H, to show that the parasitic capacitances may reduce the amounts of light intensity of light emitting elements 1, these light emitting elements 1 are hatched.

Subsequently, in the sub-frame 12, as shown by FIG. 9B, the voltage is applied to the common line C1 by the scanning portion 20, while predetermined currents are drawn by the driving portion 30 through the driving lines S0 to S2. Since the currents corresponding to the parasitic capacitances have been drawn out by the driving portion 30 in the frame FM1, three light emitting elements 1 that are connected to C1 can be driven at a desired amount of intensity. Similarly, in the sub-frame 13, as shown in FIG. 9C, three light emitting elements 1 that are connected to C2 can be driven at a desired amount of intensity. Since the operation after the sub-frame 21 is similar to the cycle CL1, its description is omitted for the sake of brevity. In addition, after the cycle CL3, similarly, light emitting elements 1 may be darker in the sub-frame 11. Since the reason is the same as CL2, its description is omitted for the sake of brevity.

As stated above, in conventional driving methods, the parasitic capacitances may reduce the amounts of light intensity of light emitting elements. For this reason, there is a problem that the darker light emitting elements may inversely affect the display quality.

See Laid-Open Patent Publication No. JP 2006-147,933 A

The present invention is devised to solve the above problems. It is a main object of the present invention to provide a display apparatus light emission control method and a display apparatus that can prevent that the amount of light intensity of a light emitting element that is first driven in each cycle is smaller than other light emitting elements, and can improve the display quality.

SUMMARY OF THE INVENTION

To achieve the above object, a light emission control method according to a first aspect of the present invention controls a display apparatus that includes a display portion 10, a scanning portion 20, and a driving portion 30. The display portion 10 includes a plurality of light emitting elements 1 that are arranged in a matrix shape. The scanning portion 20 is connected to a plurality of common lines C each of which is connected to the anode terminals of corresponding elements of the plurality of light emitting elements 1 that are arranged in corresponding one of the rows of the display portion 10. The scanning portion 20 applying a voltage to selected one of the common lines C when the common lines C are scanned by the scanning portion 20. The driving portion 30 is connected to a plurality of driving lines S each of which is connected to the cathode terminals of corresponding elements of the plurality of light emitting elements 1 that are arranged in corresponding one of the columns of the display portion 10. The driving portion activates selected elements of the plurality of light emitting elements 1 so that currents flow in the selected elements. The light emission control method controls light emission of the display apparatus so that an image is displayed in each cycle that includes a plurality of frames. The voltage is applied to the selected one of the common lines by using the scanning portion 20 in at least one light emission frame in which the light emitting elements 1 are driven in one cycle. The scanning portion 20 is prevented from applying the voltage to the common lines in at least one non-light emission frame in which the light emitting elements 1 are not driven in the one cycle.

According to this construction, since a voltage is not applied to the common lines so that a current does not flow in the driving lines in frames other than the light emission frames, it is possible to avoid that electric charge is charged as the parasitic capacitances of the driving lines, which will be charged if the driving lines are connected to the commons. Therefore, it is possible to suppress the phenomenon where the light emission amounts of the light emitting elements are reduced by the electric charge amounts corresponding to the parasitic capacitances, which may make a particular row dark.

A light emission control method according to a second aspect of the present invention controls a display apparatus that includes a display portion 10, a scanning portion 20, and a driving portion 30. The display portion 10 includes a plurality of light emitting elements 1 that are arranged in a matrix shape. The scanning portion 20 is connected to a plurality of common lines C each of which is connected to the anode terminals of corresponding elements of the plurality of light emitting elements 1 that are arranged in corresponding one of the rows of the display portion 10. The scanning portion 20 applying a voltage to selected one of the common lines C when the common lines C are scanned by the scanning portion 20. The driving portion 30 is connected to a plurality of driving lines S each of which is connected to the cathode terminals of corresponding elements of the plurality of light emitting elements 1 that are arranged in corresponding one of the columns of the display portion 10. The driving portion activates selected elements of the plurality of light emitting elements 1 so that currents flow in the selected elements. The application period of the voltage to the selected one of the common lines applied by the scanning portion 20 is changed depending on the activation periods of the driving lines by the driving portion 30.

According to this construction, application of the voltage to the selected one of the common lines can be synchronized with the activation of the driving lines. Accordingly, a voltage is not applied to the common lines so that a current does not flow in the driving lines in periods other than the light emission period. As a result, it is possible to avoid that electric charge is charged as the parasitic capacitances of the driving lines, which will be charged if the driving lines are connected to the commons. Therefore, it is possible to suppress the phenomenon where the light emission amounts of the light emitting elements are reduced by the electric charge amounts corresponding to the parasitic capacitances, which may make a particular row dark.

In a light emission control method according to a third aspect of the present invention, the light emission control method can control light emission of the display apparatus so that an image is displayed in each cycle that includes a plurality of frames. The application period of the voltage to the selected one of the common lines applied by the scanning portion 20 can be synchronized with the activation periods of the driving lines by the driving portion 30 in one frame.

According to this construction, for example, in the case where the light emitting elements are driven for 100% of one frame, the common lines are scanned for 100% of one frame, while in the case where the light emitting elements are driven for 20% of one frame, the common lines are scanned for 20% of one frame and are deactivated for the rest 80% of one frame, in other words, the voltage is not applied to the common lines for the rest 80% of one frame. Therefore, it is possible to avoid that the parasitic capacitances, which may cause a dark line, are charged.

In a light emission control method according to a fourth aspect of the present invention, the scanning portion 20 can apply the voltage to the selected one of the common lines during the longest one of light emission periods in which the light emitting elements that are connected to the selected one of the common lines are driven.

According to this construction, since the voltage application period is adjusted to the longest one of the driving periods in which the light emitting elements that are connected to selected one common line are driven by the driving portion, a desired light emission time can be surely provided.

In a light emission control method according to a fifth aspect of the present invention, the non-light emission period in which the light emitting elements 1 can be not driven is longer than the light emission period in which the light emitting elements 1 are actually driven in the maximum duration for which the light emitting elements 1 can be driven.

A display apparatus according to a sixth aspect of the present invention includes a display portion 10, a scanning portion 20, a driving portion 30, and a scanning control portion 50. The display portion 10 includes a plurality of light emitting elements 1 that are arranged in a matrix form. The scanning portion 20 is connected to a plurality of common lines C each of which is connected to the anode terminals of corresponding elements of the plurality of light emitting elements 1 that are arranged in corresponding one of the rows of the display portion 10. The scanning portion 20 applying a voltage to selected one of the common lines C when the common lines C are scanned by the scanning portion 20. The driving portion 30 is connected to a plurality of driving lines S each of which is connected to the cathode terminals of corresponding elements of the plurality of light emitting elements 1 that are arranged in corresponding one of the columns of the display portion 10. The driving portion activates selected elements of the plurality of light emitting elements 1 so that currents flow in the selected elements. The scanning control portion 50 controls light emission of the display apparatus so that an image is displayed in each cycle that includes a plurality of frames. The scanning control portion applies the voltage to the selected one of the common lines by using the scanning portion in at least one light emission frame in which the light emitting elements 1 are driven in one cycle. The scanning control portion prevents the scanning portion 20 from applying the voltage to the common lines in at least one non-light emission frame in which the light emitting elements are not driven in the one cycle.

According to this construction, since a voltage is not applied to the common lines so that a current does not flow in the driving lines in frames other than the light emission frame, it is possible to avoid that electric charge is charged as the parasitic capacitances of the driving lines, which will be charged if the driving lines are connected to the commons. Therefore, it is possible to suppress the phenomenon where the light emission amounts of the light emitting elements are reduced by the electric charge amounts corresponding to the parasitic capacitances, which may make a particular row dark.

A display apparatus according to a seventh aspect of the present invention includes a display portion 10, a scanning portion 20, a driving portion 30, and a light emission control portion 2. The display portion 10 includes a plurality of light emitting elements 1 that are arranged in a matrix form. The scanning portion 20 is connected to a plurality of common lines C each of which is connected to the anode terminals of corresponding elements of the plurality of light emitting elements 1 that are arranged in corresponding one of the rows of the display portion 10. The scanning portion 20 applying a voltage to selected one of the common lines C when the common lines C are scanned by the scanning portion 20. The driving portion 30 is connected to a plurality of driving lines S each of which is connected to the cathode terminals of corresponding elements of the plurality of light emitting elements 1 that are arranged in corresponding one of the columns of the display portion 10. The driving portion activates selected elements of the plurality of light emitting elements 1 so that currents flow in the selected elements. The scanning control portion 2 changes the application period of the voltage to the selected one of the common lines applied by the scanning portion 20 depending on the activation periods of the driving lines activated by the driving portion 30.

According to this construction, application of the voltage to the selected one of the common lines can be synchronized with the activation periods of the driving lines. Accordingly, a voltage is not applied to the common lines so that a current does not flow in the driving lines in periods other than the light emission period. As a result, it is possible to avoid that electric charge is charged as the parasitic capacitances of the driving lines, which will be charged if the driving lines are connected to the commons. Therefore, it is possible to suppress the phenomenon where the light emission amounts of the light emitting elements are reduced by the electric charge amounts corresponding to the parasitic capacitances, which may make a particular row dark.

A display apparatus according to an eight aspect of the present invention, the light emission control portion 2 can control light emission of the display apparatus so that an image is displayed in each cycle that includes a plurality of frames. The light emission control portion 2 can synchronize the application period of the voltage to the selected one of the common lines applied by the scanning portion 20 with the activation periods of the driving lines by the driving portion 30 in one frame.

According to this construction, for example, in the case where the light emitting elements are driven for 100% of one frame, the common lines are scanned for 100% of one frame, while in the case where the light emitting elements are driven for 20% of one frame, the common lines are scanned for 20% of one frame and are deactivated for the rest 80% of one frame, in other words, the voltage is not applied to the common lines for the rest 80% of one frame. Therefore, it is possible to avoid that the parasitic capacitances, which may cause a dark line, are charged.

A display apparatus according to a ninth aspect of the present invention, the scanning portion 20 can apply the voltage to the selected one of the common lines during the longest one of light emission periods in which the light emitting elements 1 that are connected to the selected one of the common lines are driven.

According to this construction, since the voltage application period is adjusted to the longest one of the driving periods in which the light emitting elements that are connected to selected one common line are driven by the driving portion, a desired light emission time can be surely provided.

A display apparatus according to a tenth aspect of the present invention, the light emission control portion 2 can prevent the scanning portion 20 from applying the voltage to the common lines in the non-light emission frame based on an external control signal from an external device that is connected to the display apparatus.

According to this construction, since the application of the voltage by the scanning portion is controlled from the outside, there is an advantage where the processing of the display apparatus can be simplified.

The above and further objects of the present invention as well as the features thereof will become more apparent from the following detailed description to be made in conjunction with the accompanying drawings.

DETAILED DESCRIPTION OF THE EMBODIMENT(S)

The following description will describe embodiments according to the present invention with reference to the drawings. It should be appreciated, however, that the embodiments described below are illustrations of a light emission control method and a display apparatus used therein to give a concrete form to technical ideas of the invention, and a light emission control method and a display apparatus of the invention are not specifically limited to description below. Furthermore, it should be appreciated that the members shown in claims attached hereto are not specifically limited to members in the embodiments. Unless otherwise specified, any dimensions, materials, shapes and relative arrangements of the parts described in the embodiments are given as an example and not as a limitation. Additionally, the sizes and the positional relationships of the members in each of drawings are occasionally shown larger exaggeratingly for ease of explanation. Members same as or similar to those of this invention are attached with the same designation and the same reference signs, and their description is omitted. In addition, a plurality of structural elements of the present invention may be configured as a single part that serves the purpose of a plurality of elements, on the other hand, a single structural element may be configured as a plurality of parts that serve the purpose of a single element. Also, the description of some of examples or embodiments may be applied to other examples, embodiments or the like.

In this specification, the term "parasitic capacitance" mainly refers to the parasitic capacitance of a driving line S. However, the "parasitic capacitance" is not limited to this. The "parasitic capacitance" can include the capacitive component of other part such as the capacitance of an electronic part that is connected to the driving line.

First Embodiment

Figure 1:
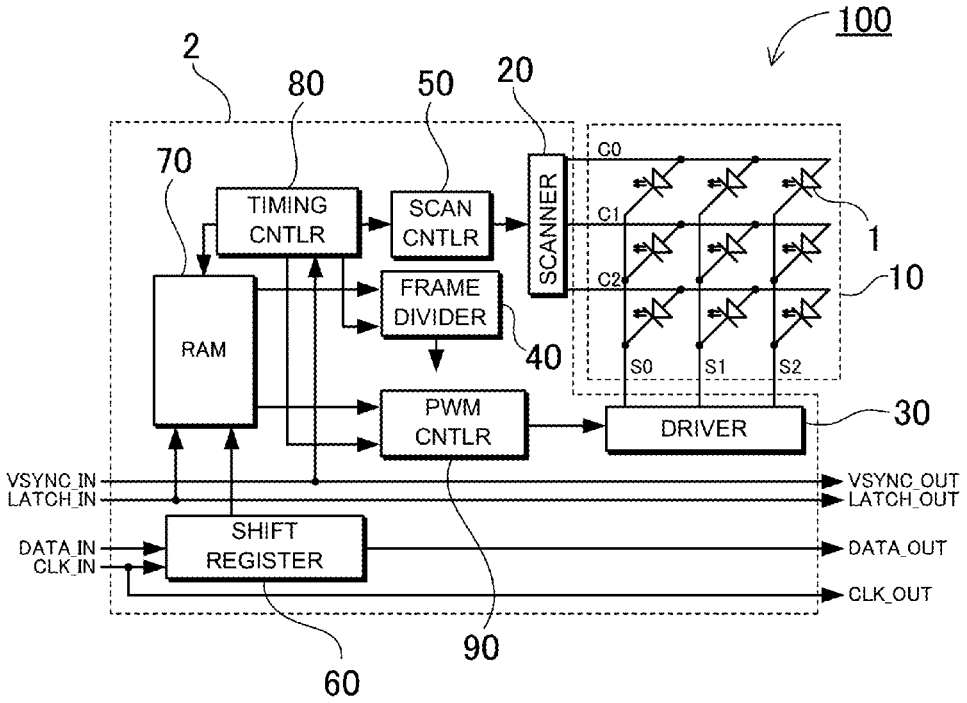
FIG. 1 is a block diagram showing a display apparatus according to a first embodiment of the present invention.
Figure 2:
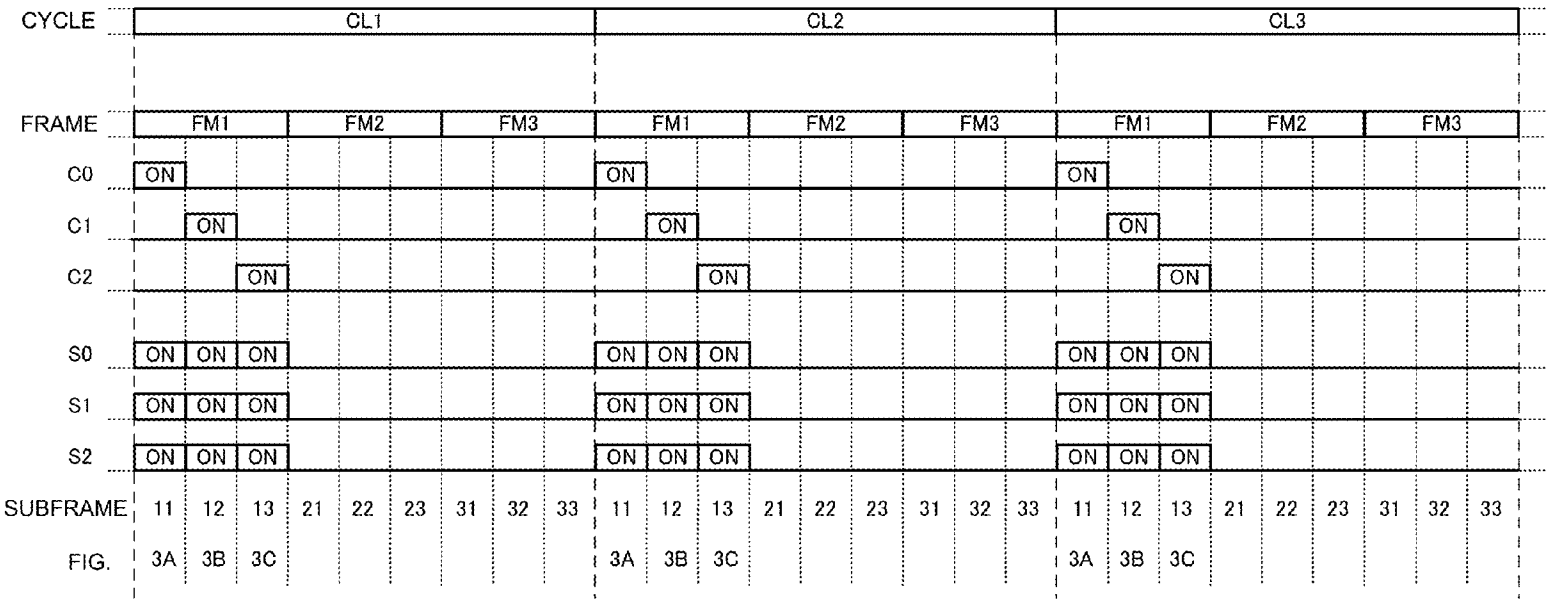
FIG. 2 is a timing chart showing a light emission control method according to the first embodiment of the present invention.
Figures 3A, 3B, 3C:
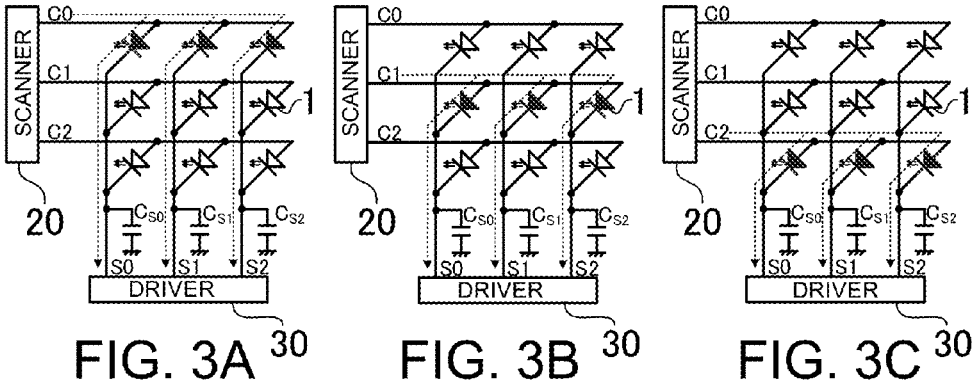
FIGS. 3A to 3C are circuit diagrams showing current flows in the display apparatus in sub-frames 11 to 13 shown in FIG. 2.

FIG. 1 is a block diagram showing a display apparatus 100 according to a first embodiment of the present invention. FIG. 2 is a timing chart showing a light emission control method for driving the display apparatus 100. FIGS. 3A to 3C are circuit diagrams showing current flows indicated by the arrows in the display apparatus in sub-frames shown in FIG. 2.

(Display Portion)

The display apparatus 100 includes a display portion 10 and a light emission control portion 2, as shown in FIG. 1. The display portion 10 includes a plurality of light emitting elements 1, a plurality of common lines C0 to C2, and a plurality of driving lines S0 to S2. The light emitting elements 1 are arranged in a matrix. Each of the common lines C0 to C2 is connected to the anode terminals of the light emitting elements 1 that are arranged in corresponding one of rows. Each of the common lines S0 to S2 is connected to the cathode terminals of the light emitting elements 1 that are arranged in corresponding one of columns.

(Light Emission Control Portion 2)

The light emission control portion 2 includes a frame division portion 40, a scanning portion 20, a driving portion 30, and a scanning control portion 50. The frame division portion 40 divides one cycle for displaying one image into a plurality of frames. The scanning portion 20 is connected to the common lines C. The common lines C are scanned in each frame by the scanning portion 20. The scanning portion 20 can apply a voltage to the common lines C. The driving portion 30 is connected to the driving lines S, and can drive selected light emitting elements 1 in corresponding one of the frames in one cycle based on control data provided from the outside. The scanning control portion 50 is connected to the scanning portion 20, and allows/prevents the scanning of the common lines in frames of one cycle.

Figure 7A:
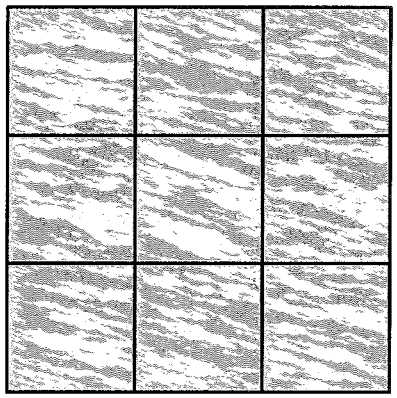
FIG. 7A (RELATED ART)
FIG. 7A is a plan view schematically showing a display apparatus.
Figure 7B:
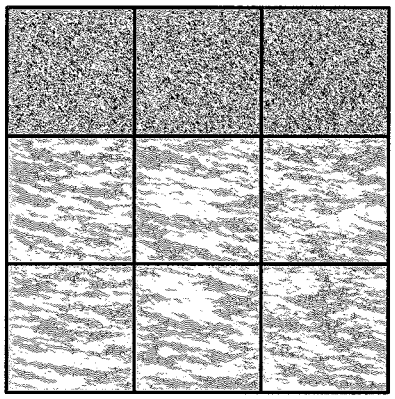
FIG. 7B (RELATED ART)
FIG. 7B is a plan view schematically showing the display apparatus shown in FIG. 7A with one row being darker in light emission.

The light emission control portion 2 controls the display portion 10 in the light emission control method of light emission timing shown in FIG. 2. As a result, it is possible to prevent the phenomenon where the amount of light emission of a conventional display portion 10 partially decreases as shown in FIG. 7B, that is, to prevent the appearance of "dark line". Therefore, it is possible to provide uniform and quality image as shown in FIG. 7A. The following description will describe the light emission control method.

Figure 8:
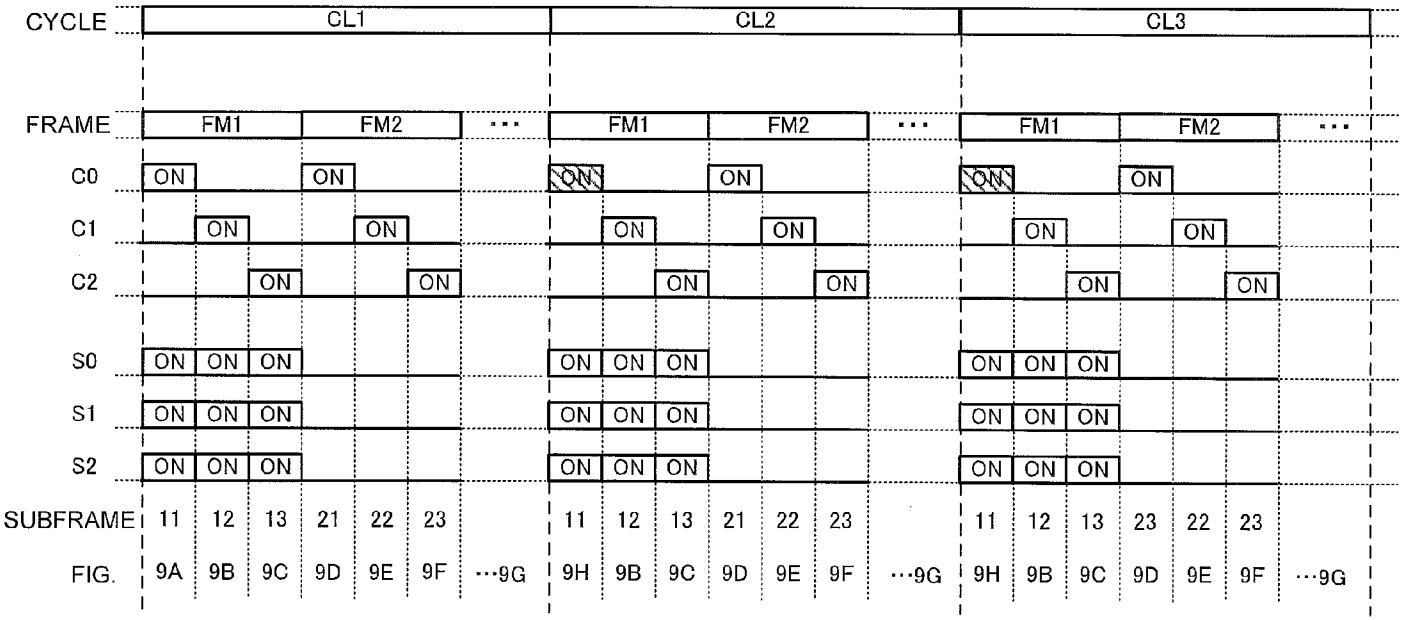
FIG. 8 (RELATED ART)
FIG. 8 is a timing chart of a conventional light emission control method for driving the display apparatus.
Figure 9A:
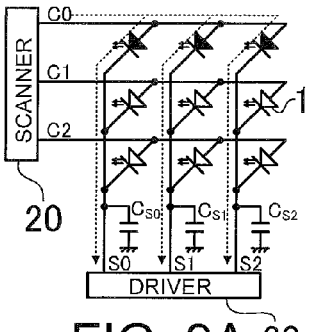
FIG. 9A (RELATED ART)
FIGS. 9A to 9H are circuit diagrams showing current flows in the display apparatus in sub-frames 11 to 23 shown in FIG. 8.
Figure 9B:
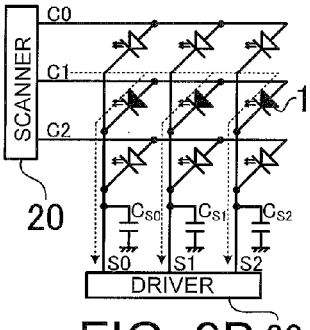
FIG. 9B (RELATED ART)
Figure 9C:
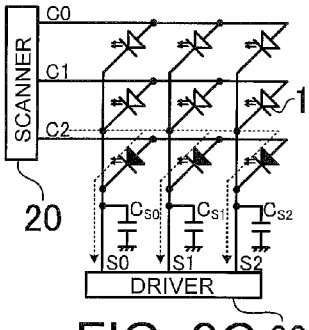
FIG. 9C (RELATED ART)
Figure 9D:
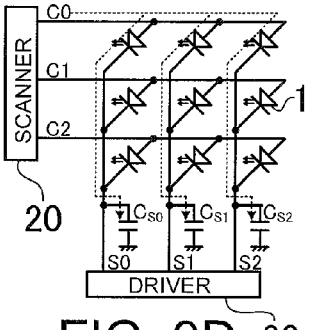
FIG. 9D (RELATED ART)
Figure 9E:
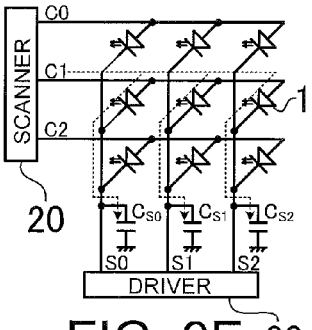
FIG. 9E (RELATED ART)
Figure 9F:
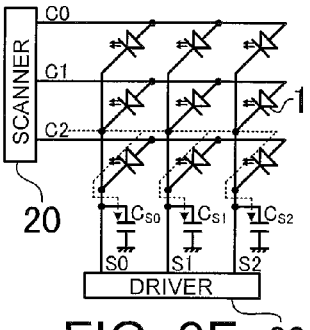
FIG. 9F (RELATED ART)
Figure 9G:
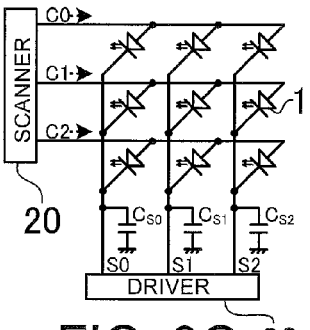
FIG. 9G (RELATED ART)
Figure 9H:
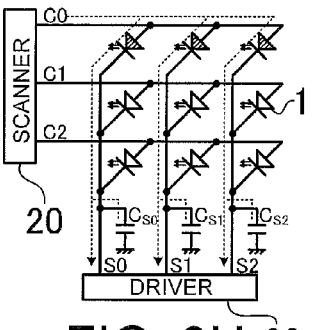
FIG. 9H (RELATED ART)

In conventional light emission control methods, the scanning order of the common lines C is fixed in ascending numeric order as shown in FIG. 8 in every cycle. In this case, in each cycle, after the driving lines are activated in the first frame, the driving lines are deactivated so that the light emitting elements are not driven. However, the common lines are scanned even during the sub-frames in which the driving lines are not activated. Accordingly, electric charge will be charged as the parasitic capacitances of the driving lines in the sub-frames in which the driving lines are not activated. As a result, when the light emitting elements are driven in the first frame in the subsequent cycle, as shown by the hatched block in FIG. 8, since the charged parasitic capacitances are discharged, the amounts of currents of the light emitting elements that are first driven will be reduced by the amounts corresponding to the charged parasitic capacitances so that the amounts of currents of these light emitting elements become smaller as compared with other light emitting elements, in other words, the so-called "dark line" appears. Although the dark line is inconspicuous in motion video or at high brightness, the dark line will be conspicuous in still image particularly at low brightness, which in turn causes poor image quality. To address this, in this embodiment, the common lines are scanned only during the sub-frames in which the driving lines are activated, while it is prevented that the common lines are scanned during the sub-frames in which the driving lines are not activated to avoid that electric charge is charged as the parasitic capacitances of the driving lines. Therefore, it is possible to prevent the appearance of dark line.

Specifically, as shown in FIG. 2, in the display apparatus 100 according to the first embodiment, in the cycle CL1, the driving lines S0, S1, and S2 are activated in the first frame FM1 in which the driving lines are activated, and the driving lines S0, S1, and S2 are deactivated in the other frames FM2 and FM3. Correspondingly, the common lines are scanned only in the frame FM1, and are not scanned in the other frames FM2 and FM3. The scanning control portion 50 controls the scanning operation of the scanning portion 20 so that scanning and non-scanning sub-frames are provided. In the scanning sub-frame, the common lines are scanned. In the non-scanning sub-frame, the scanning operation is prevented. Similar in subsequent cycles CL2 and CL3, the scanning sub-frame of the common lines is set correspondingly to the activation sub-frames of the driving lines. In other words, similarly, the common line scanning operation cooperates with the driving line activating operation so that the common line are not scanned during the deactivation sub-frames in which the driving lines are deactivated. As a result, it is possible to prevent the appearance of dark line.

The aforementioned operation is described with reference to the circuit diagrams of FIGS. 3A to 3C. Current flows are shown by the arrows in these diagrams. In addition, the virtual equivalent capacitors $C_{S0}$ to $C_{S2}$ that are included as parasitic capacitances in the lines are shown on the driving lines S.

The display apparatus 100 includes the light emitting elements 1, three common lines C0 to C2, and three driving lines S0 to S2, as discussed above. The light emitting elements 1 are arranged in the matrix with three rows and three columns (totally nine light emitting elements). Each of the three common lines C0 to C2 is connected to the anode terminals of three of the light emitting elements 1 that are arranged in corresponding one of rows. Each of the three driving lines S0 to S2 is connected to the cathode terminals of three of the light emitting elements 1 that are arranged in corresponding one of columns. In the light emission control method shown in FIG. 2, each of the cycles CL1 to CL3 is divided into a plurality of frames (FM1, FM2, . . . ) for driving the display portion. The assumed operation is that, in each cycle, all of light emitting elements are driven at the minimum intensity (the minimum level) only in FM1, and all of light emitting elements are turned OFF in other frames, for sake of brevity. That is, in each cycle, all of the light emitting elements are driven at the minimum intensity. In FIG. 2, although it is shown as if the light emitting elements 1 connected to the driving lines S0, S1, and S2 are driven at the maximum intensity (maximum level) in the sub-frames 11, 12, and 13 in the frame FM1 in each cycle for ease of illustration, the assumed operation is that the light emitting elements are driven at the minimum intensity (the minimum level).

The operation of the cycle CL1 is now described. In the cycle CL1, the scanning order of the common lines C is set to the order of the common lines C0, C1, and C2 in each frame. That is, this scanning order of the common lines C is ascending numeric order. In other words, the scanning order of the common lines C is same as conventional light emission control method shown in FIG. 8. Specifically, in the sub-frame 11 in the frame FM1 shown in FIG. 2, the voltage is applied to the common line C0 by the scanning portion 20, while predetermined currents are drawn by the driving portion 30 through the driving lines S0 to S2, as shown in FIG. 3A. Accordingly, three light emitting elements 1 that are connected to C0 are driven at a desired amount of intensity. In the sub-frame 12, the voltage is applied to the common line C1, and predetermined currents are drawn through the driving lines S0 to S2. As a result, three light emitting elements 1 that are connected to the common line C1 are driven at a desired light intensity amount as shown in FIG. 3B. In the sub-frame 13, the voltage is applied to the common line C2, and predetermined currents are drawn through the driving lines S0 to S2. As a result, three light emitting elements 1 that are connected to the common line C2 are driven at a desired light intensity amount as shown in FIG. 3C.

Similarly, in the subsequent cycle CL2, the common lines are scanned in the scanning order of C0, C1, and C2 in the sub-frames 11, 12, and 13, and the driving lines are activated in the activation order of S0, S1, and S2. Accordingly, as shown in FIGS. 3A, 3B, and 3C, the common lines C0, C1, and C2 are driven at desired intensity amounts. As a result, it is possible to prevent that unnecessary voltage is not applied in the sub-frames in which the driving lines are deactivated. Therefore, it is possible to prevent the appearance of dark line. Also in subsequent cycle CL3, the common lines C0, C1, and C2 are scanned in synchronization with the activation sub-frames of the driving lines S0, S1, and S2 so that the voltage is applied to the common lines C0, C1, and C2. Accordingly, the light emitting elements emit desired amounts of intensity. In addition, it is possible to prevent the appearance of dark line.

According to this method, it is possible to prevent to avoid that electric charge is charged as the parasitic capacitances of the driving lines if the common lines are scanned in the sub-frames in which the driving lines are deactivated. Therefore, it is possible to prevent the appearance of dark line. As a result, it is possible to provide a quality display apparatus that can display the image without light emission unevenness caused by the dark line in the case where a still image is displayed at low light intensity. In particular, in the case where the same image is displayed in successive cycles as still image, if only a particular row becomes dark, the particular row will be very conspicuous. According to the aforementioned control method, even in the case of a still image where a dark line is likely to be conspicuous, since the appearance of dark line is prevented, quality images can be displayed.

In addition, according to this method, the scanning order of the common lines is not changed. Accordingly, it is not required to change the control operation for the common lines. For this reason, existing controllers can be used as the scanning control portion 50. Also, it is simply required to activate the driving lines only in the sub-frame in which the driving lines are necessarily activated, and to fix the operation of the driving lines. Additionally, it is not required to change the activation timing order of the driving lines. Accordingly, for example, as compared with the control method that randomly changes the scanning order or the activation order depending on cycles, there is an advantage that the control operation can be relatively easily changed in the method according to this embodiment, since the method according to this embodiment does not require changing the scanning order, the activation order, or the like.

As discussed above, the voltage is applied to common lines by the scanning portion 20 in the light emission sub-frames in which the light emitting elements are driven in one cycle, and the scanning portion 20 is prevented from applying the voltage to the common lines in the non-light emission sub-frames in which the light emitting elements are not driven in the one cycle. Thus, the voltage is not applied to the common lines except in the light emission sub-frames. As a result, it is possible to prevent to avoid that electric charge is charged as the parasitic capacitances of the driving lines, which are connected to the common lines. Therefore, it is possible to prevent the appearance of dark line.

In this embodiment, it has been described that the driving lines for the light emitting elements are activated/deactivated depending on frames, while scanning operation for the common lines are performed/prevented also depending on frames. In addition, when the driving portion 30 activates the driving lines and stops activating the driving lines in one frame, the scanning portion 20 can correspondingly stop scanning the common lines in the one frame. It is not necessarily required to prevent scanning the common lines only depending on frames. The prevention of common line scanning can be suitably adjusted also depending control operation for the driving lines.

Although the common lines are sequentially scanned in the order of C0, C1, and C2 in the embodiment as shown in FIG. 2, the present invention is not limited to this. The common lines may be scanned one after another in a random order.

In addition, the application period of the voltage to the selected one of the common lines applied by the scanning portion 20 can be changed depending on the activation periods of the driving lines activated by the driving portion 30 so that the application period of the voltage to the selected one of the common lines applied by the scanning portion 20 can be synchronized with the activation periods of the driving lines activated by the driving portion 30. According to this construction, application period of the voltage to the selected one of the common lines can be synchronized with the activation periods of the driving lines. Accordingly, a voltage is not applied to the common lines so that a current does not flow in the driving lines in periods other than the light emission period. As a result, it is possible to avoid that electric charge is charged as the parasitic capacitances of the driving lines, which will be charged if the driving lines are connected to the commons. Therefore, it is possible to suppress the phenomenon where the light emission amounts of the light emitting elements are reduced by the electric charge amounts corresponding to the parasitic capacitances, which may make a particular row dark (dark line). Specifically, the application period of the voltage to the common line by the scanning portion 20 is adjusted to coincide with the activation periods of the driving line by the driving portion 30. In other words, the scanning portion 20 does not apply the voltage to the common lines during the non-activation period in which the driving portion 30 deactivates the driving lines. That is, the non-activation period coincides with the non-application period in which the scanning portion does not apply the voltage to the common lines.

In addition, when the light emission is controlled so that an image is displayed in each cycle, which includes a plurality of frames, the application period of the voltage to the selected one of the common lines by the scanning portion 20 can be synchronized with the activation periods of the driving lines by the driving portion 30 in one frame. According to this construction, for example, in the case where the light emitting elements are driven for 100% of one frame, the common lines are scanned for 100% of one frame, while in the case where the light emitting elements are driven for 20% of one frame, the common lines are scanned for 20% of one frame and are deactivated for the rest 80% of one frame, in other words, the voltage is not applied to the common lines for the rest 80% of one frame. Therefore, it is possible to avoid that the parasitic capacitances, which may cause a dark line, are charged.

In addition, the scanning portion 20 can apply the voltage to the selected one of the common lines during the longest one of light emission periods in which the light emitting elements that are connected to said selected one of said common lines are driven. According to this construction, since the voltage application period is adjusted to the longest one of the driving periods in which the light emitting elements that are connected to selected one common line are driven by the driving portion 30, a desired light emission time can be surely provided.

In addition, the non-light emission period can be longer than the light emission period in the maximum duration. In the non-light emission period, the light emitting elements are not driven. In the light emission period, the light emitting elements are actually driven. The maximum duration is the maximum available duration in which the light emitting elements allowed to emit light.

The foregoing embodiments have been described that one cycle includes three frames, and one frame includes three sub-frames. However, needless to say, one cycle can include any number of frames, while one frame can includes any number of sub-frames.

(Display Portion 10)

The following description describes main components of the light emission display apparatus 100 that can emit light based on any of the light emission control methods according to the foregoing first embodiment. The display portion 10 includes the plurality of common lines C, which are arranged in the rows in parallel to each other, and the plurality of driving lines S, which are arranged in the columns perpendicular to the row in parallel to each other. The plurality of light emitting elements 1 are connected between the common lines C and the driving lines S. Thus, the light emitting elements 1 are arranged in a matrix. Specifically, the common lines C corresponds to the rows, while the driving lines S corresponds to the columns in FIG. 1. Thus, the light emitting elements 1 are arranged in a matrix with m rows and n columns. The cathode terminals of the light emitting elements 1 of each column is connected to corresponding one of the driving lines S, while the anode terminals of the light emitting elements 1 of each row is connected to corresponding one of the common lines C.

Although the display portion 10 is described to include the light emitting elements 1 that are arranged in a matrix with three rows and three columns, needless to say, the display portion can include light emitting elements that are arranged in a matrix with any number of rows and any number of columns. In this specification, the "row" and "column" refer to the horizontal and vertical directions, respectively, for ease of explanation. However, the "row" and "column" are not limited to the horizontal and vertical directions. That is, the "row" and "column" can have a directional relationship relative to each other. For example, the "row" and "column" may refer to the vertical and horizontal directions, respectively, in other words, the display apparatus 100 may be turned by 90 degrees in the clockwise or counterclockwise direction in FIG. 1.

(Light Emitting Element 1)

The light emitting elements 1 are semiconductor light emitting elements. Typically, light emitting diodes (LEDs) can be used as the semiconductor light emitting elements. In this embodiment, LEDs are used as the light emitting elements 1.

(Scanning Portion 20)

The scanning portion 20 is connected to the common lines C. Any of the common lines C can be scanned by the scanning portion 20 so that a voltage (e.g., 5 V) is applied to the selected one of the common lines C one after another. The scanning portion 20 includes switches (not shown) corresponding to the common lines C, and controls ON/OFF of the common lines C based on the instructions from the scanning control portion 50.

(Driving Portion 30)

The driving portion 30 includes the driving elements (not shown) that are connected to the driving lines S, and can drive the light emitting elements 1 based on the instructions from a PWM controller 90. An image can be displayed in each cycle by combination of frame level control based on display data read from a RAM 70 and PWM level control controlled by a PWM controller 90 in each frame.

(Frame Division Portion 40)

The frame division portion 40 divides one cycle CL into a plurality of frames FM. One cycle CL corresponds to one image to be displayed that is generated by a timing controller 80 as discussed later.

In this embodiment, the display apparatus 100 includes the frame division portion 40. However, the display apparatus may be constructed without the frame division portion 40. The reason is that, even in the case where the display apparatus does not include the frame division portion, the parasitic capacitance on the driving line S will be charged if there is a time period where the driving portion 30 does not draw the current when the common line C is selected by the scanning portion 20. Also, in this case, the dark line may appear.

(Scanning Control Portion 50)

The scanning portion 20 scans the common lines C, and stops scanning the common lines C based on the instructions from the scanning control portion 50. In this embodiment, the scanning control portion 50 controls the scanning portion 20 so that application of the voltage to selected one of the common lines C is switched between activation and deactivation. The scanning control portion 50 may autonomously control the scanning order of the common lines C. Alternatively, the scanning control portion 50 may be constructed to control the scanning order of the common lines C based on the instructions from the outside. In this case, the scanning control portion 50 prevents the scanning portion 20 from applying the voltage to the common lines in the non-light emission frame based on an external control signal from an external device. In this case, the processing of the display apparatus can be simplified.

(Shift Register 60)

A shift register 60 provides display data DAT A_IN corresponding to one image from the outside in accordance with the shift clock CLK_IN. The shift register 60 can retain the display data, which includes frame level data and PWM level data for all of the light emitting elements 1 of the display portion 10.

(RAM 70)

A RAM 70 retains data in the shift register 60 in accordance with LATCH_IN. Although not illustrated, in order to control the display operation in the display portion 10, two or more independent RAMs are provided to read data from the frame division portion 40 and the PWM controller 90, and to write the display data from the outside, i.e., the data in the shift register 60.

(Timing Controller 80)

The timing controller 80 generates the cycle in accordance with VSYNC_IN, and controls the timing of the control portions.

(PWM Controller 90)

The PWM controller 90 controls the PWM level based on the display data read from the RAM 70 in the frame, which generated by the frame division portion 40.

Second Embodiment

Figure 4:
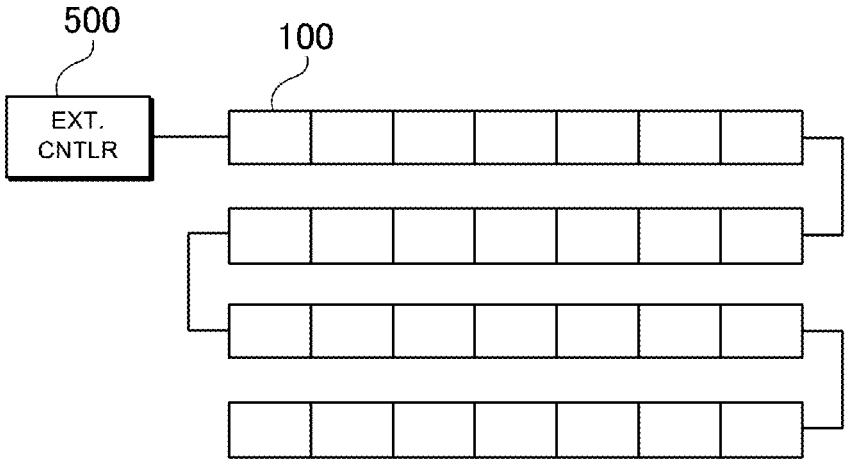
FIG. 4 is a block diagram for illustrating a display system according to a second embodiment of the present invention.

Although the foregoing embodiments have been described to use the display apparatus alone, the present invention is not limited to this. A plurality of display apparatuses can be connected to each other so that a large display system is constructed of the plurality of display apparatuses. FIG. 4 shows this type of display system according to a second embodiment. In this illustrated display system, the plurality of display apparatuses 100 are connected to each other, while an external control portion 500 is connected to the end of a series of the plurality of display apparatuses 100. The external control portion 500 provides control data including display data and the like to the display apparatuses 100. Thus, the display system is constructed. Therefore, it is possible to provide a display system capable of suppressing the dark line.

Third Embodiment

Figure 5:
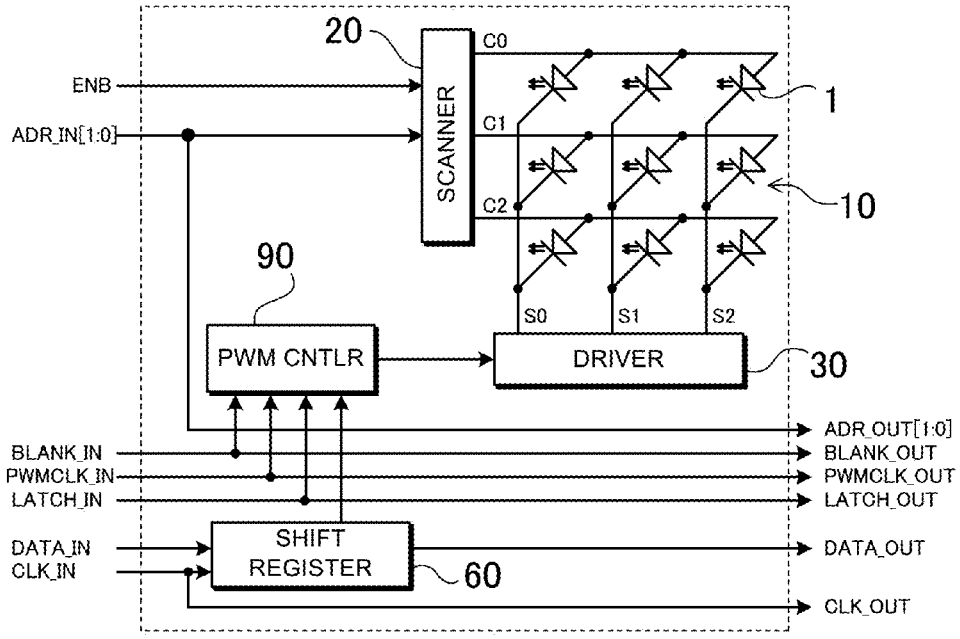
FIG. 5 is a block diagram for illustrating a display apparatus to be used for a display apparatus according to a third embodiment of the present invention.

In the display apparatuses according to the first and second embodiments, the scanning control portion 50, which is included in the display unit, controls allowance/prevention of the scanning operation for the common lines in one cycle. However, even in the case where the display apparatus does not include the scanning control portion 50, the scanning operation for the common lines can be prevented by the control data from the external control portion. That is, the control data from the external control portion contains scanning control data for setting allowance/prevention of the scanning operation. According to this construction, it is possible to provide a display apparatus having effects similar to the second embodiment. FIG. 5 is a block diagram showing this type of display apparatus according to a third embodiment.

In the display apparatus according to this embodiment, the external control portion generates the frames, and controls the levels in each frame. The frames are combined so that one image is displayed in one cycle. The levels are controlled in each frame by controlling the PWM controller 90 based on PWMCLK_IN, which is a control signal from the external control portion, and BLANK_IN, which is a reset signal for a PWM counter.

The scanning portion 20 is controlled in each frame not by the scanning control portion 50 but by scanning order control data ADR_IN [1:0] from the external control portion. In this embodiment, 2-bit data is enough to select one of C0 to C2. In addition, an enable signal ENB is inputted to the scanning portion 20 so that the scanning portion 20 controls allowance/prevention of the scanning operation for the common lines, (i.e., application of the voltage to the common lines) based on the enable signal ENB.

EXAMPLE 1

The following description describes a display apparatus according to an example 1 of the present invention that includes LEDs arranged in 32 rows×32 columns. Although not illustrated, the display portion includes four sets of common lines, and four sets of driving lines. Each set of common lines includes eight common lines C0 to C7. Each set of driving lines includes eight driving lines S0 to S7. 1024 LEDs are connected to the common and driving lines correspondingly at the intersection between the common and driving lines. More specifically, each of the LEDs includes three light emitting elements of red, green, and blue. The main components such as the scanning portion 20 and the driving portion 30 are similar to the first embodiment (FIG. 1), and their description is omitted for sake of brevity.

Figure 6:
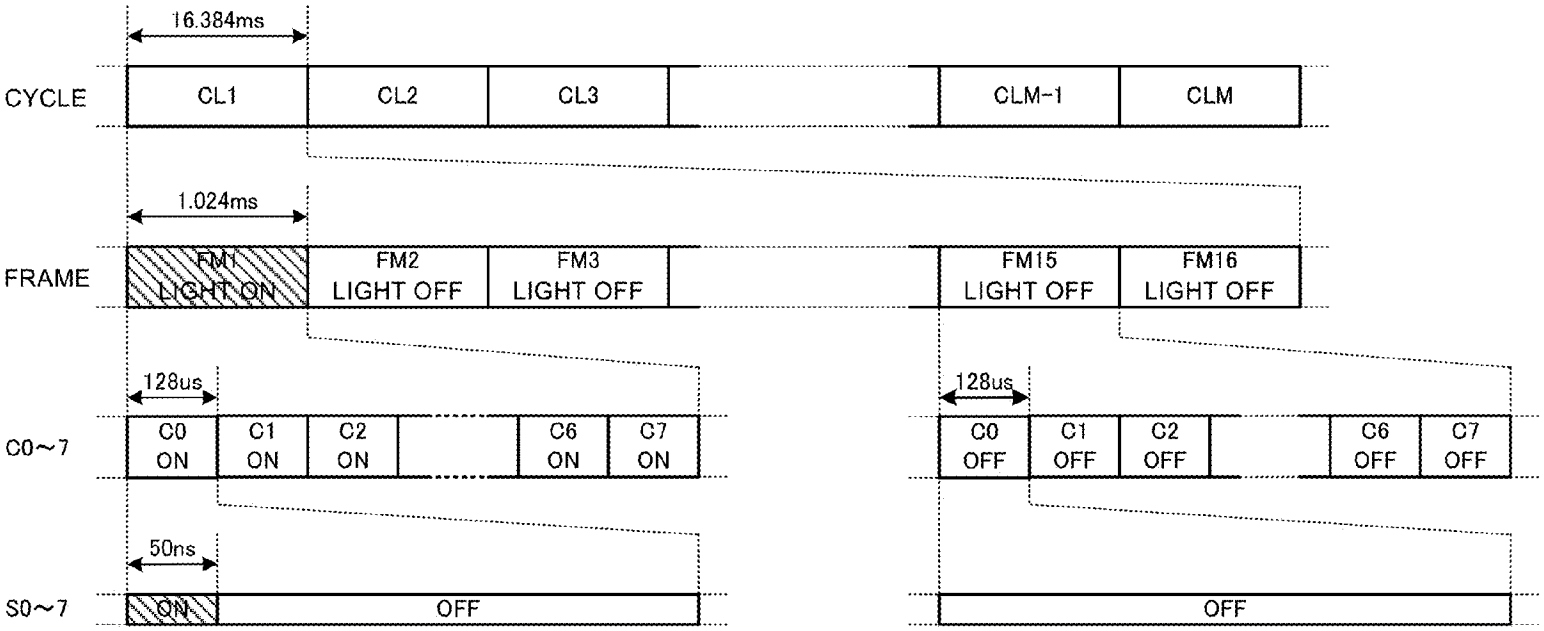
FIG. 6 is a timing chart showing the display apparatus according to the first embodiment of the present invention.

The display apparatus according to this example is driven in a ⅛-duty dynamic driving manner. As shown in a timing chart of FIG. 6, one cycle of 16.384 ms includes 16 frames. Specifically, in the cycle CL1, the common lines are scanned in the order of C0, C1, . . . , C6, and C7 in each frame. In CL2 and CL3, the common lines are scanned similar to CL1. In this example, in the frame in which the driving portion does not activate the driving lines, the scanning portion is prevented from scanning the common lines.

In this display apparatus, all of the LEDs are driven in FM1 in every cycle for 50 ns, which is the minimum time unit where the dark line is likely to be conspicuous. Even in the case where all of the LEDs are driven at the minimum light intensity, the dark line can be inconspicuous in this example as compared with a comparative example 1. According to this example, a quality display apparatus can be provided.

COMPARATIVE EXAMPLE 1

The same display unit as the example 1 is produced as the comparative example 1 except that the common lines are scanned by the scanning portion scanning even in the frame in which the driving portion does not activate the driving lines. In the comparative example 1, when all of the LEDs are driven in FM1 in every cycle for 50 ns, which is the minimum time unit, the dark line appears in the LEDs that are arranged in C0.

INDUSTRIAL APPLICABILITY

A display apparatus light emission control method and display apparatus according to the present invention can be used for a large television and traffic information, for example.

It should be apparent to those with an ordinary skill in the art that while various preferred embodiments of the invention have been shown and described, it is contemplated that the invention is not limited to the particular embodiments disclosed, which are deemed to be merely illustrative of the inventive concepts and should not be interpreted as limiting the scope of the invention, and which are suitable for all modifications and changes falling within the scope of the invention as defined in the appended claims.

The present application is based on Application No. 2011-284,554 filed in Japan on Dec. 26, 2011, the content of which is incorporated herein by reference.

What is claimed is:

1. A light emission control method for a display apparatus, the display apparatus including a display portion that includes a plurality of light emitting diodes that are arranged in a matrix form, each of said light emitting diodes having an anode terminal and a cathode terminal, a scanning portion that is connected to a plurality of common lines each of which is connected to the anode terminal of a corresponding diode of said plurality of light emitting diodes that are arranged in corresponding one of the rows of said display portion, the scanning portion applying a voltage to selected one of said common lines when said common lines are scanned by the scanning portion, and a driving portion that is connected to a plurality of driving lines having associated parasitic capacitances, each of said parasitic capacitances being formed between said cathode terminal of each light emitting diode and ground, each of said plurality of driving lines being connected to the cathode terminals of corresponding diodes of said plurality of light emitting diodes that are arranged in corresponding one of the columns of said display portion, the driving portion activating selected diodes of said plurality of light emitting diodes so that currents flow in the selected diodes, wherein a cycle comprises a plurality of frames, wherein at least one of the frames comprises a light emission period in which the selected diodes are driven, and wherein at least one of the frames comprises a non-light emission period in which the selected diodes are not driven, the light emission control method comprises:

changing the application period of the voltage to the selected one of the common lines applied by said scanning portion depending on the activation periods of said driving lines activated by said driving portion;

scanning the selected one of the common lines in the light emission period with said scanning portion; and not scanning the common lines in the non-light emission period with said scanning portion, to avoid charging an electric charge in said parasitic capacitances of said driving lines.

2. The light emission control method according to claim 1, wherein the light emission control method comprises:

applying the voltage to the selected one of said common lines by using said scanning portion in at least one light emission frame in which said light emitting diodes are driven in one cycle, depending on activation periods of the driving lines activated by the driving portion, and preventing said scanning portion from applying the voltage to said common lines in at least one non-light emission frame in which said light emitting diodes are not driven in the one cycle, depending on non-activation periods of the driving lines activated by the driving portion.

3. The light emission control method according to claim 1, wherein the light emission control method controls light emission of the display apparatus so that an image is displayed in each cycle, wherein the application period of the voltage to the selected one of the common lines applied by said scanning portion are synchronized with the activation periods of said driving lines activated by said driving portion in one frame.

4. The light emission control method according to claim 1, wherein said scanning portion applies the voltage to the selected one of said common lines during the longest one of light emission periods in which the light emitting diodes that are connected to said selected one of said common lines are driven.

5. The light emission control method according to claim 1, wherein the non-light emission period in which the light emitting diodes are not driven is longer than the light emission period in which said light emitting diodes are actually driven in the maximum duration for which said light emitting diodes can be driven.

6. The light emission control method according to claim 1, wherein the voltage is not applied to the common lines so that a current does not flow in the driving lines in periods other than a light emission period.

7. The light emission control method according to claim 1, wherein the non-light emission period is at least as long at the light emission period.

8. The light emission control method according to claim 1, wherein the non-light emission period is longer than the light emission period.

9. The light emission control method according to claim 1, wherein not scanning the common lines in the non-light emission period with said scanning portion includes not scanning a common line which subsequently emits light in the light emission period of a successive cycle.

10. A display apparatus comprising:

a display portion that includes a plurality of light emitting diodes that are arranged in a matrix form, each of said light emitting diodes having an anode terminal and a cathode terminal:

a scanning portion that is connected to a plurality of common lines each of which is connected to the anode terminal of a corresponding diode of said plurality of light emitting diodes that are arranged in corresponding one of the rows of said display portion, the scanning portion applying a voltage to selected one of said common lines when said common lines are scanned by the scanning portion;

a driving portion that is connected to a plurality of driving lines having associated parasitic capacitances, each of said parasitic capacitances being formed between said cathode terminal of each light emitting diode and ground, each of said plurality of driving lines being connected to the cathode terminals of corresponding diodes of said plurality of light emitting diodes that are arranged in corresponding one of the columns of said display portion, the driving portion activating selected diodes of said plurality of light emitting diodes so that currents flow in the selected diodes; and a light emission control portion that changes the application period of the voltage to the selected one of the common lines applied by said scanning portion depending on the activation periods of said driving lines activated by said driving portion, wherein a cycle comprises a plurality of frames, wherein at least one of the frames comprises a light emission period in which the selected diodes are driven, wherein at least one of the frames comprises a non-light emission period in which the selected diodes are not driven, and wherein the light emission control portion is configured to control the scanning portion to scan the selected one of the common lines in the light emission period, while not scanning the common lines in the non-light emission period to avoid charging an electric charge in said parasitic capacitances of said driving lines.

11. The display apparatus according to claim 10, wherein the light emission control portion controls light emission of the display apparatus so that an image is displayed in each cycle, wherein the light emission control portion synchronizes the application periods of the voltage to the selected common lines applied by said scanning portion with the activation periods of said driving lines by said driving portion in one frame.

12. The display apparatus according to claim 11, wherein the light emission control portion is configured to apply the voltage to the selected one of said common lines by using said scanning portion in at least one light emission frame in which said light emitting diodes are driven in one cycle, depending on the activation periods of the driving lines activated by the driving portion, and wherein the light emission control portion is configured to prevent said scanning portion from applying the voltage to said common lines in at least one non-light emission frame in which said light emitting diodes are not driven in the one cycle, depending on non-activation periods of the driving lines activated by the driving portion.

13. The display apparatus according to claim 10, wherein said scanning portion applies the voltage to the selected one of said common lines during the longest one of light emission periods in which the light emitting diodes that are connected to said selected one of said common lines are driven.

14. The display apparatus according to claim 10, wherein said light emission control portion prevents said scanning portion from applying the voltage to said common lines in the non-light emission frame based on an external control signal from an external device that is connected to the display apparatus.

15. The display apparatus according to claim 10, wherein the light emission control portion does not apply the voltage to the common lines so that a current does not flow in the driving lines in periods other than a light emission period.

16. The display apparatus according to claim 10, wherein the scanning portion applies the voltage to the selected one of said common lines in the application period, the application period comprising a light emission frame in which the selected diodes are driven in one cycle, and the light emission control portion prevents the scanning portion from applying a voltage to the common lines in a non-light emission period comprising a non-light emission frame subsequent to the light emission frame.

17. The display apparatus according to claim 10, wherein the non-light emission period is at least as long at the light emission period.

18. The display apparatus according to claim 10, wherein the non-light emission period is longer than the light emission period.

19. The display apparatus according to claim 10, wherein the light emission control portion is configured to control the scanning portion to not scan the common lines in the non-light emission period, including not scanning a common line which subsequently emits light in the light emission period of a successive cycle.

* * * * *